US009630433B2

(12) United States Patent
Wagener

(10) Patent No.: US 9,630,433 B2
(45) Date of Patent: Apr. 25, 2017

(54) METHOD FOR DETERMINING PIXEL DROPOUT

(71) Applicant: ENTRUST DATACARD CORPORATION, Shakopee, MN (US)

(72) Inventor: Thomas J. Wagener, Shorewood, MN (US)

(73) Assignee: ENTRUST DATACARD CORPORATION, Shakopee, MN (US)

( * ) Notice: Subject to any disclaimer, the term of this patent is extended or adjusted under 35 U.S.C. 154(b) by 0 days.

(21) Appl. No.: 14/796,210

(22) Filed: Jul. 10, 2015

(65) Prior Publication Data

US 2015/0314623 A1 Nov. 5, 2015

Related U.S. Application Data

(63) Continuation of application No. 13/902,193, filed on May 24, 2013, now Pat. No. 9,102,156.

(51) Int. Cl.

| | |
|---|---|
| ***B41J 29/393*** | (2006.01) |
| ***B41J 2/165*** | (2006.01) |
| ***B41J 2/125*** | (2006.01) |
| ***B41J 2/32*** | (2006.01) |
| ***B41J 2/045*** | (2006.01) |
| ***B41J 2/355*** | (2006.01) |

(52) U.S. Cl.

CPC ..... *B41J 29/393* (2013.01); *B41J 2/0451* (2013.01); *B41J 2/0458* (2013.01); *B41J 2/125* (2013.01); *B41J 2/165* (2013.01); *B41J 2/16579* (2013.01); *B41J 2/32* (2013.01); *B41J 2/355* (2013.01)

(58) Field of Classification Search

CPC ..... B41J 2002/012; B41J 2/0057

See application file for complete search history.

(56) References Cited

U.S. PATENT DOCUMENTS

| | | | | |
|---|---|---|---|---|
| 6,792,161 | B1 | 9/2004 | Imaizumi et al. | |
| 7,176,941 | B2 | 2/2007 | Stamm et al. | |
| 2004/0141209 | A1* | 7/2004 | Marumoto ..... | H04N 1/4078 358/3.26 |
| 2006/0114258 | A1 | 6/2006 | Stamm et al. | |
| 2006/0125902 | A1 | 6/2006 | Figov | |
| 2009/0009812 | A1 | 1/2009 | Sirringhaus et al. | |

(Continued)

FOREIGN PATENT DOCUMENTS

| | | |
|---|---|---|
| CN | 102991157 | 3/2013 |
| JP | 2000050062 | 2/2000 |
| WO | 2006056808 | 6/2006 |

OTHER PUBLICATIONS

International Search Report and Written Opinion for International Application No. PCT/US2014/031682, mailed Jul. 16, 2014, 12 pgs.

(Continued)

*Primary Examiner* — Justin Seo

(74) *Attorney, Agent, or Firm* — Hamre, Schumann, Mueller & Larson, P.C.

(57) ABSTRACT

A technique is described for determining pixel dropout in a printhead that has a plurality of print elements arrayed along an axis. In the technique, a dataset of integrated intensity values, in the printing direction on a substrate, of a captured image is generated and used to determine if pixel dropout has or may have occurred.

19 Claims, 8 Drawing Sheets

(56) References Cited

U.S. PATENT DOCUMENTS

| | | | | |
|---|---|---|---|---|
| 2011/0221808 | A1* | 9/2011 | Onishi | B41J 2/01 347/9 |
| 2012/0092409 | A1 | 4/2012 | Wu et al. | |
| 2013/0057611 | A1 | 3/2013 | Wu et al. | |
| 2014/0192104 | A1* | 7/2014 | Toyama | B41J 2/0057 347/1 |

OTHER PUBLICATIONS

"Dirac delta function" found online at http://en.wikipedia.org/wiki/Dirac_delta_function, last modified on Jul. 26, 2013 (30 pages).
"Memjet Technology," found online at http://www.memjet.com/technology, Aug. 13, 2013 (3 pages).
Office Action of Chinese Application No. 201480041632.0, dated Jun. 24, 2016, 7 pages.

* cited by examiner

METHOD FOR DETERMINING PIXEL DROPOUT

FIELD

The technical disclosure herein relates to a method of determining pixel dropout in a printhead having multiple print elements such as thermal printheads and ink jet printheads with multiple jets.

BACKGROUND

Pixel dropout is a common issue within the printing industry. The dropout could result from a number of problems, for example a failed resistor element in the case of a thermal printhead or a blocked jet in the case of a multiple jet inkjet printhead. When pixel dropout occurs, it typically results in a vertical or horizontal line on the substrate being printed on, depending upon the printing direction since ink or dye is not being transferred from the failed print element to the substrate.

Substrates that are printed with pixel dropout are often considered defective and need to be disposed of, and are often remade which increases costs. Therefore, if pixel dropout does occur, it is best if the dropout is detected as soon as possible to minimize the number of defectively printed substrates.

SUMMARY

A technique is described for determining pixel dropout in a printhead that has a plurality of print elements arrayed along an axis. In the technique, an image is analyzed for symmetries that result in a statistically significant signature indicating the possible occurrence of pixel dropout. In one example, a dataset of integrated intensity values, in the printing direction on a substrate, of a captured image is generated and used to determine if pixel dropout has or may have occurred.

In one embodiment, a method of determining pixel dropout of a printhead that has a plurality of print elements arrayed along a first axis includes printing on a surface of a substrate using the printhead by moving the substrate and the printhead relative to one another in a printing direction that is generally perpendicular to the first axis. After printing, a mechanical image capture device is used to capture an image of the surface of the substrate or a portion of a print ribbon that was used to print on the substrate. The captured image is then inputted into a processing device which generates a dataset of integrated intensity values, in the printing direction, of the captured image. The dataset is then used to determine if pixel dropout has occurred.

In another embodiment, a system includes a printhead having a plurality of print elements arrayed along a first axis, a mechanical image capture device associated with the printhead to capture an image printed on a surface of a substrate using the printhead or to capture an image of a portion of a print ribbon that was used to print on the substrate using the printhead, and a processing device connected to the mechanical image capture device and receiving the captured image from the mechanical image capture device. The processing device is configured to generate a dataset of integrated intensity values, in a printing direction, of the captured image, and the processing device is configured to analyze the generated dataset to determine if pixel dropout has occurred and to generate an alert signal if pixel dropout has occurred.

The printhead can be any type of printing device that has a generally linear array of individual print elements disposed generally along an axis, where any one or more of the individual print elements can fail or dropout. Examples of printheads include, but are not limited to, a thermal printhead that includes a line of individual resistor print elements, or a multiple jet inkjet printhead that includes a linear array of individual jets that form print elements. The printhead can perform monochrome (i.e. single color) printing or multicolor printing. A single printhead can be used, or multiple printheads can be provided. Also, the printhead can be stationary and the substrate being printed moves relative to the printhead, or the printhead can move while the substrate remains stationary.

The substrate can be any substrate that can be printed on. Examples of substrates include, but are not limited to, paper, cards, passport pages, retransfer films used in retransfer printing, and others.

The mechanical image capture device can be any device that is capable of capturing a two dimensional image. Examples of mechanical capture devices include, but are not limited to, cameras and scanners.

The captured image can be an image of the surface of the substrate, for example a sheet of paper, a plastic card, a passport page, a retransfer film. Alternatively, in the case of printing using a print ribbon that transfers dye to a substrate, the captured image can be a portion of the print ribbon that was used to print on the substrate, since a reverse of the image that is printed on the substrate will be left on the print ribbon.

As used herein, the language "pixel dropout has occurred" is intended to mean that the described method can determine actual pixel dropout, as well as detect one or more indicators that pixel dropout may have occurred. A user is alerted if it appears that pixel dropout has occurred, allowing the user to investigate further whether or not pixel dropout has actually occurred or if some other problem has occurred that resulted in the pixel dropout detection even if the printhead is operating correctly. For sake of convenience, "pixel dropout has occurred" may be used in this description and is intended to encompass both actual pixel dropout as well as the possibility that pixel dropout may have occurred.

DRAWINGS

DETAILED DESCRIPTION

Figure 1:
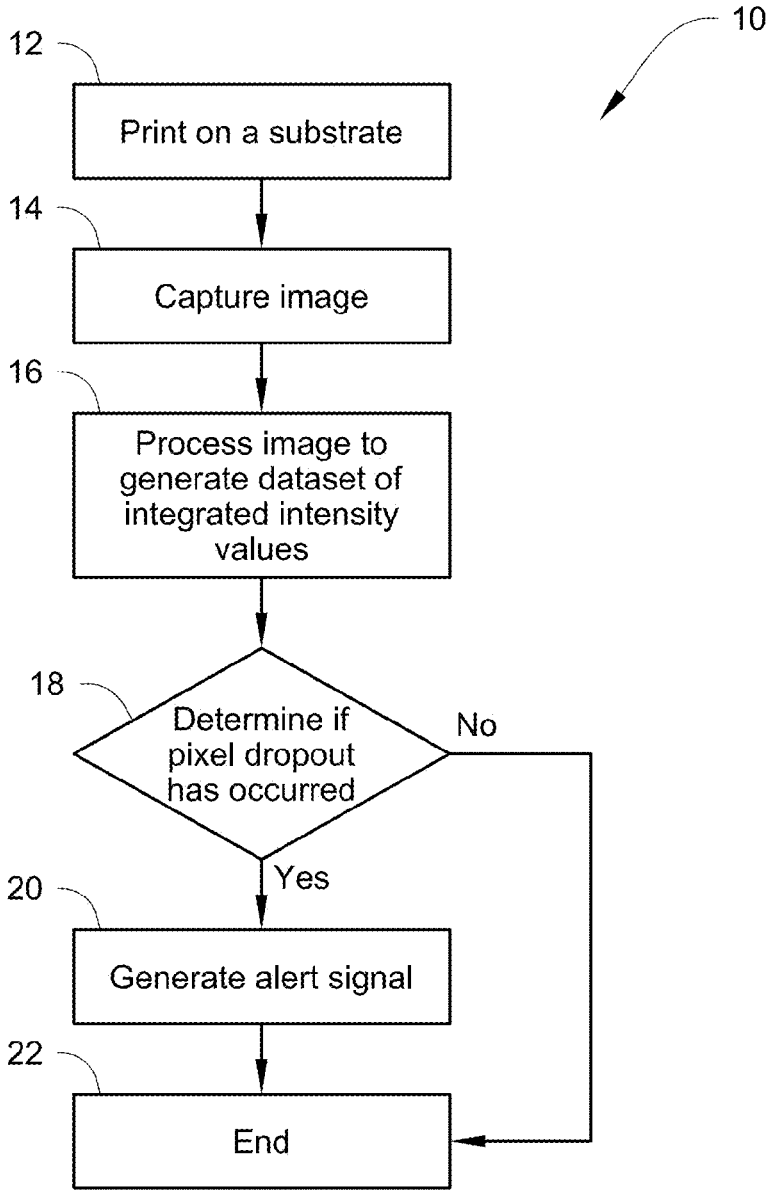
FIG. 1 illustrates a method of determining pixel dropout as described herein.

With reference initially to FIG. 1, a method 10 of determining pixel dropout is illustrated. The method 10 begins by printing on a substrate 12. After printing, an image of the surface of the substrate or a portion of a print ribbon that was used to print on the substrate is captured 14. The captured image is then input 16 into a processing device which processes the captured image and generates a dataset of integrated intensity values. The processing device then uses the generated dataset to determine if pixel dropout has or may have occurred 18. If it is determined that pixel dropout has or may have occurred, the processing device can generate an alert signal 20 to alert a technician or other suitable person that pixel dropout has or may have occurred so corrective action can be taken if necessary. The method then ends 22. At step 18, if it has been determined that pixel dropout has not occurred, the method ends 22.

The printhead that performs the printing can be any type of printing device that has a generally linear array of individual print elements disposed generally along an axis, where any one or more of the individual print elements can fail or dropout. Examples of printheads include, but are not limited to, a thermal printhead that includes a line of individual resistor print elements, or a multiple jet inkjet printhead that includes a linear array of individual jets that form print elements. An example of such a multiple jet printhead is available from Memjet of San Diego, Calif. The printhead can perform monochrome (i.e. single color) printing or multi-color printing. A single printhead can be used, or multiple printheads can be provided. Also, the printhead can be stationary and the substrate being printed moves relative to the printhead, or the printhead can move while the substrate remains stationary.

The substrate can be any substrate that can be printed on. Examples of substrates include, but are not limited to, paper, cards, passport pages, retransfer films used in retransfer printing, and others. In one embodiment, the substrates are personalized security documents, for example plastic cards including but not limited to financial (e.g. credit and debit) cards, drivers' licenses, national identification cards, gift cards, employee badges, and other plastic cards which bear personalized data unique to the card holder and/or which bear other card or document information, as well as passports or passport pages.

The image is captured by a mechanical image capture device which can be any device that is capable of capturing a two dimensional image. Examples of mechanical capture devices include, but are not limited to, cameras and scanners. In an embodiment, the image capture device has a resolution greater than or approximately equal to a resolution of the printhead. For example, if the printhead prints at around 300 DPI, the image capture device should have a resolution of at least about 300 DPI.

The captured image can be an image of the surface of the substrate, for example a sheet of paper, a plastic card, a passport page, a transfer film. Alternatively, in the case of printing using a print ribbon that transfers dye to the substrate, the captured image can be a portion of the print ribbon that was used to print on the substrate, since a reverse of the image that is printed on the substrate will be left on the print ribbon.

The processing device used to process the captured image, generate the dataset of integrated intensity values, determine if pixel dropout has occurred, generate the alert signal, and perform other processing tasks described herein, can be one or more data processors, the general construction of which are known, but which is programmed to perform the described processing tasks.

Figure 2:
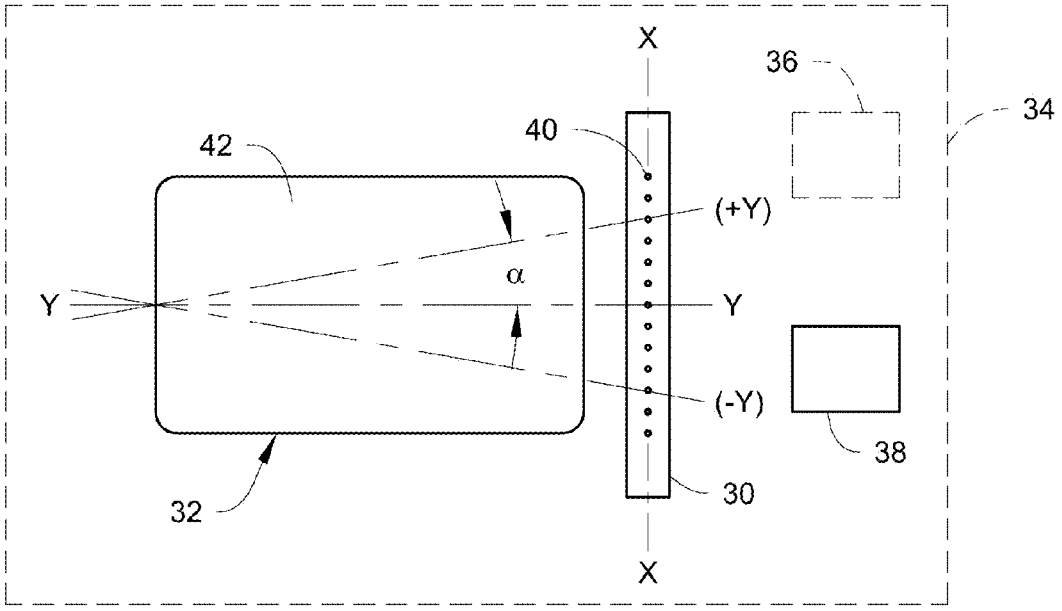
FIG. 2 illustrates an example of a printhead printing on a substrate.

With reference to FIG. 2, an example of a printhead 30 that can print on a substrate 32 is illustrated. The printhead 30 is part of a printing system 34 that can include a processing device 36 that can, for example, control operation of the entire printing system 34, control operation of just the printhead 30, or control operation of the printhead and one or more other functions of the printing system 34. The printing system 34 also includes a mechanical image capture device 38 at any suitable location downstream of the printhead 30 that captures the image after printing.

The printhead 30 is illustrated as being a thermal printhead that includes a plurality of individual resistor elements 40 arrayed along an axis X-X. The construction and operation of thermal printheads is well known in the art. By electrically stimulating select resistor elements 40, the stimulated elements are heated. The heated elements transfer dye from a ribbon that is disposed between the substrate 32 and the printhead 30 as the substrate and the printhead are moved relative to one another in a printing direction Y-Y. In one embodiment, the substrate 32 is moved relative to the printhead 30 which remains stationary. However, it is possible to move the printhead in the printing direction while the substrate remains fixed. The printhead 30 can be used with a monochrome print ribbon such as black, or be used with a multi-color print ribbon such as a CMYK ribbon. Therefore, the printing on the substrate 32 can be monochromatic or multi-color.

The substrate 32 has a surface 42 that will be printed on by the printhead 30 in the printing direction Y-Y. The printing direction Y-Y is typically intended to be substantially perpendicular to the axis X-X ignoring normal manufacturing tolerances. However, the printing direction Y-Y can vary by any amount as long as the integration occurs along the path of relative travel between the printhead and the substrate.

After printing, the image capture device 38 captures the image. As indicated above, the image can be of the surface 42 of the substrate 32. Alternatively, the image can be a portion of the print ribbon that was used to print on the substrate. In either case, the image capture device 38 is suitably positioned to capture the image.

In one specific embodiment, the substrate 32 can be a plastic card, a passport or a page of a passport, in which case the printing system 34 can be a processing system for processing plastic cards or passports. In one example, the processing system can be a desktop processing machine which has a relatively small footprint intended to permit the processing machine to reside on a desktop. In another example, the processing system can be part of a large volume batch production machine, often configured with multiple processing stations or modules, that processes multiple documents at the same time.

Figure 3:
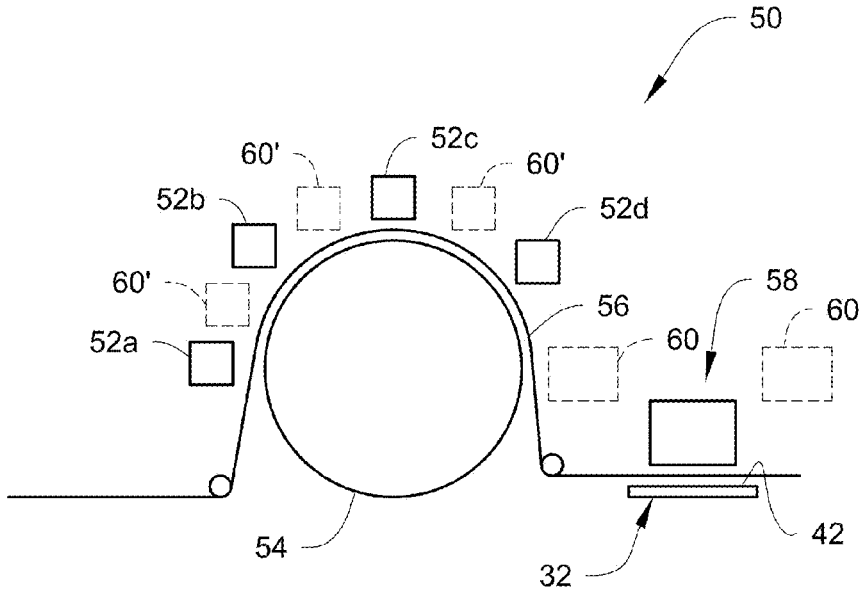
FIG. 3 illustrates an example of multiple printheads printing on a transfer film substrate.

FIG. 3 illustrates another example of a printing system 50 configured as a retransfer printer that employs multiple printheads 52*a*, 52*b*, 52*c*, 52*d* disposed around a print drum 54. In this example, the printheads 52*a-d* can be thermal printheads similar to the printhead 30 in FIG. 2. Each printhead 52*a-d* has associated with it a print ribbon having a specific color. For example, the printhead 52*a* can print cyan, the printhead 52*b* can print magenta, the printhead 52*c* can print yellow, and the printhead 52*d* can print black.

The printheads 52*a-d* each print onto a substrate 56 in the form of a retransfer film to form a multi-color image on the retransfer film. The retransfer film moves past the printheads 52*a-d* in a printing direction similar to that discussed above for FIG. 2. Once the complete image is printed, the image on the film is brought to an image transfer station 58 that transfers a portion of the film containing the printed image to the surface 42 of the substrate 32. So the printheads 52*a-d* can be considered to print directly onto the substrate 56 or print indirectly onto the substrate 32. An example of a printer of this type is the ARTISTA® VHD retransfer printer available from DataCard Corporation of Minnetonka, Minn.

Similar to the system 34 in FIG. 2, the system 50 can include an image capture device 60 at a suitable location therein for capturing the image. For example, in one example, the image capture device 60 can be located to capture the image on the substrate 56 (i.e. on the transfer film). In another example, the image capture device 60 can be located downstream of the transfer station 58 to capture the image on the substrate 32 after the transfer film has been transferred onto the substrate 32.

Figure 4:
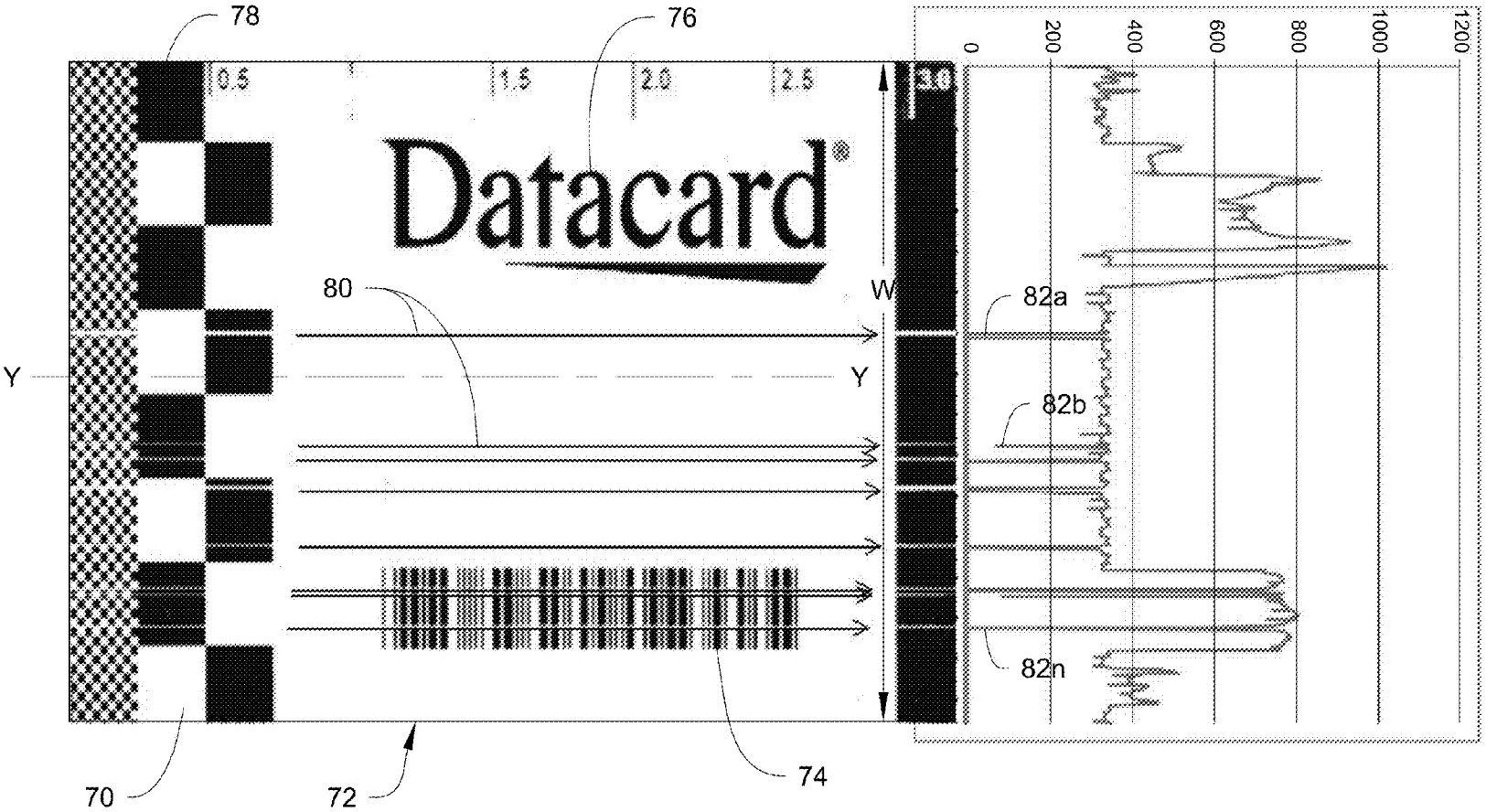
FIG. 4 illustrates an example of a black and white printed substrate and a plot of integrated intensity values.

With reference now to FIG. 4, an example of a monochrome image 70 is shown printed on a surface of a white substrate 72 to form an overall black and white image. In this example, the image 70 is shown as including a bar code 74, text data 76, and graphics printing 78 such as a checkerboard pattern. The image 70 is printed in the printing direction Y-Y. These are examples only and the substrate can be printed with any kind of data and/or graphics.

As illustrated by the arrows 80 in FIG. 4, certain ones of the print elements on the printhead used to print the image have failed, resulting in lines (i.e. pixel dropout) being formed on the image 70. The lines form because the failed print elements fail to transfer dye or ink to the substrate 72. In addition, the lines are straight lines because the printing direction Y-Y remains nominally perpendicular to the printhead during printing. The presence of those lines can be detected to determine if any of the print elements on the printhead have failed.

One way of determining whether pixel dropout has occurred is for the processing device to process the captured image by generating a dataset of integrated intensity values, in the printing direction Y-Y, of the captured image along the entire width W of the image 70. The right-hand side of FIG. 4 shows a plot of the integrated intensity values over the entire width W. As can be seen, the intensity values vary along the width W based on the cumulative amount of printing that occurs on the substrate at any point. However, wherever pixel dropout has occurred, a sharp, delta function-like discontinuity in the integrated intensity values appears since no printing occurs along the card in the print direction Y-Y. The plot in FIG. 4 shows a number of delta function-like discontinuities 82*a,b . . . n*. As used herein, a delta function-like discontinuity is an abrupt change in the integrated intensity value, when compared to adjacent values, at a particular location along the width W.

In the case of the integrated intensity values being generated from a captured image of the substrate, the delta function-like discontinuity is characterized by a rapid decrease in the integrated intensity value and that just as quickly returns to an expected background level. In the case of the integrated intensity values being generated from a print ribbon used to print ribbon, the delta function-like discontinuity would be characterized by a rapid increase in the integrated intensity value and that just as quickly falls back down or reduces to an expected background level (i.e. essentially opposite of the plotted intensity values shown in FIG. 4).

In one embodiment, a delta function-like discontinuity can be determined to exist based on an amount or percentage of change in the integrated intensity value relative to an expected background level determined by the intensity on either side of the discontinuity. For example, a delta function-like discontinuity can be determined to exist if the percentage change relative to the expected background is equal to or greater than about 25%, or equal to or greater than about 50%, or equal to or greater than about 75%. In another example, a delta function-like discontinuity can be determined to exist if the integrated intensity value reaches or approaches zero.

Therefore, the processing device can generate a dataset of integrated intensity values like that shown in FIG. 4, and analyze the plotted dataset for any delta function-like discontinuities in the integrated intensity values. If a delta function-like discontinuity is discovered, the processing device can generate the alert signal to indicate an actual or possible problem with the printhead.

Figure 7:
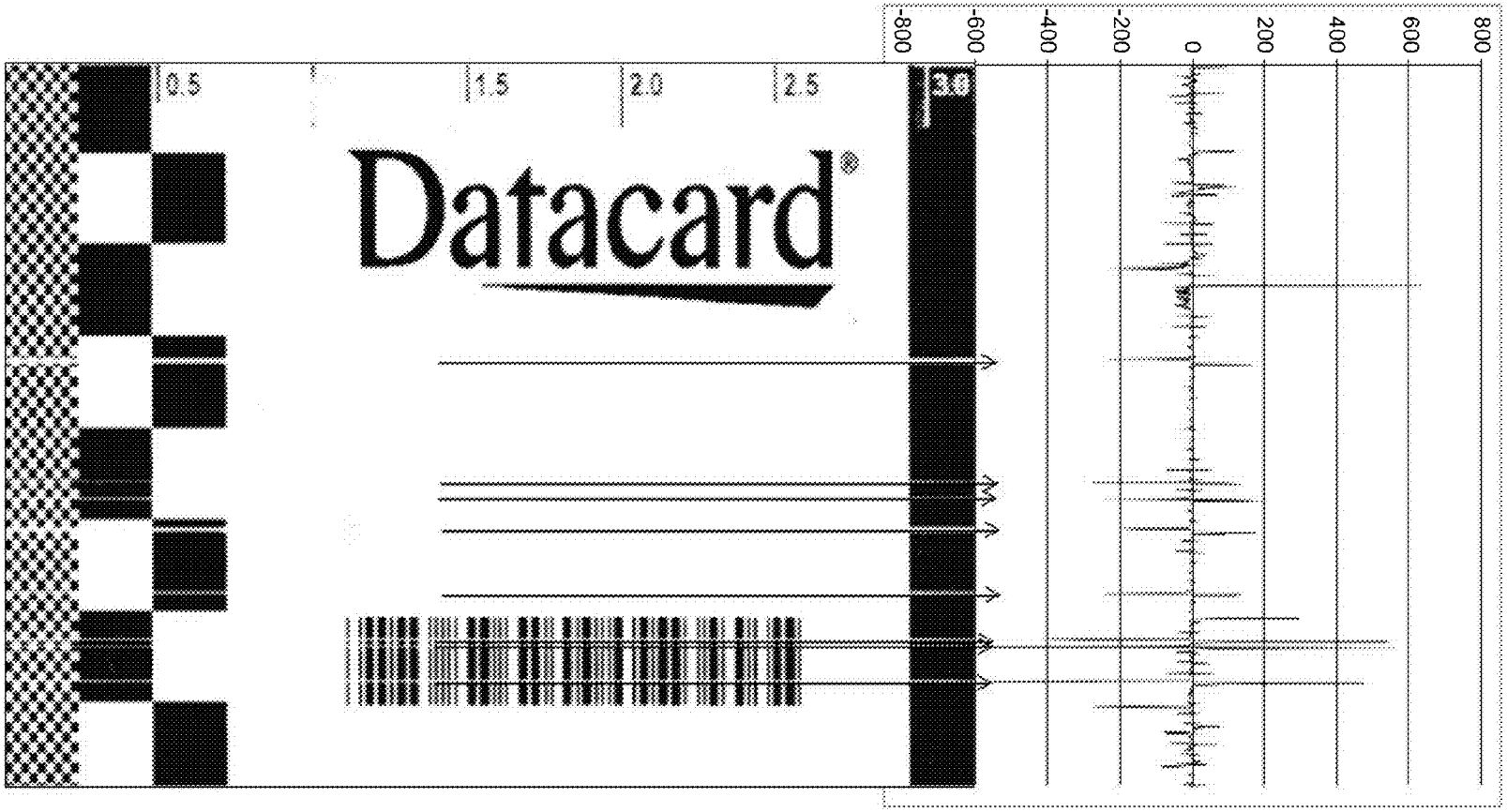
FIGS. 7-8 illustrate the use of a first derivative calculation to analyze for pixel dropout.
Figure 8:
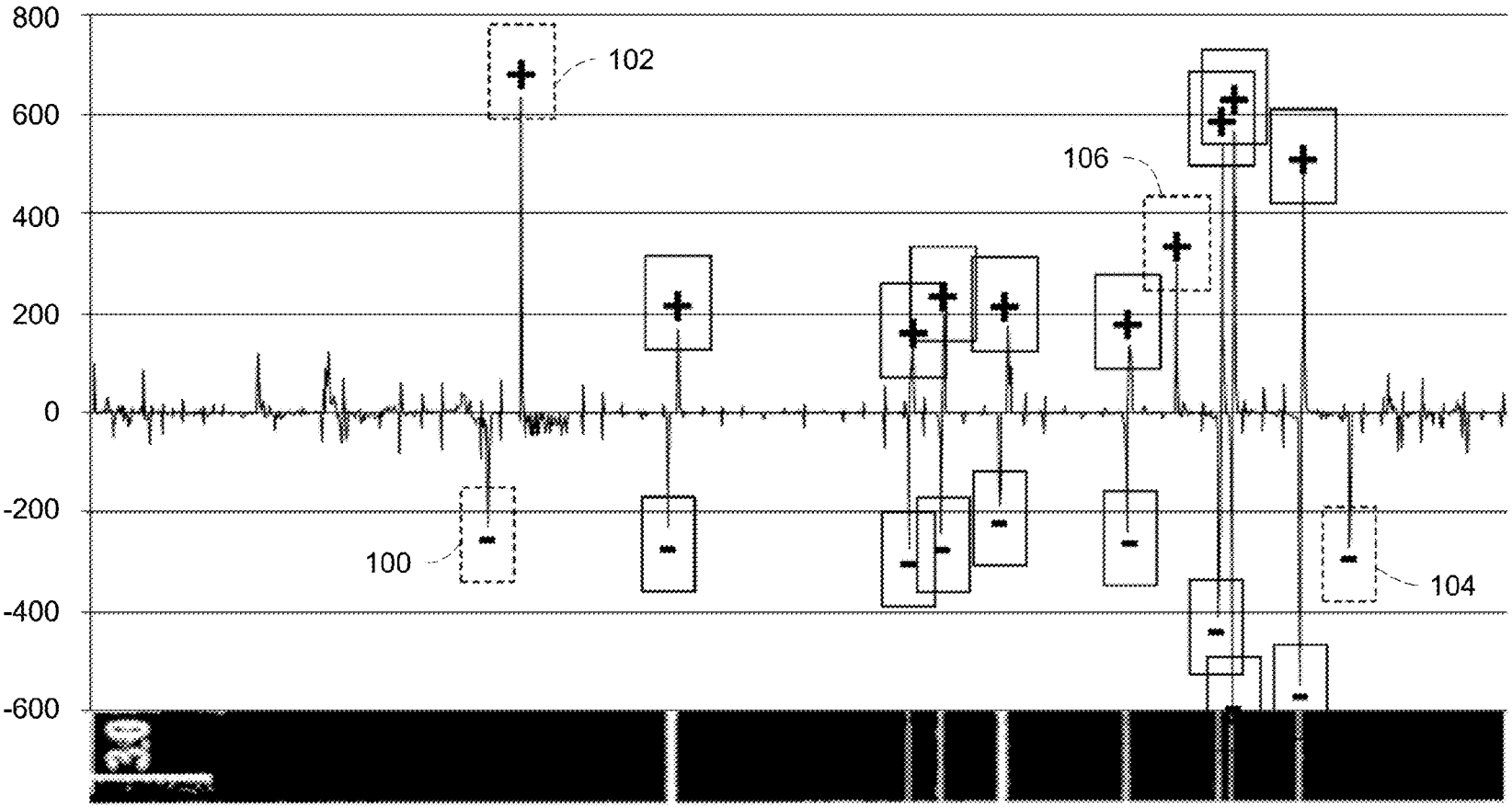

The processing device can perform other mathematical calculations on the dataset of integrated intensity values, for example performing first derivative calculations as shown in FIGS. 7 and 8. After calculating the first derivative, the processing device would search for "–/+" pairs as shown in FIG. 8. The first "–" 100 and the first "+" 102, indicated in dashed lines, are isolated and also have substantially different intensities, and thus are not likely to reflect the signature of a pixel dropout. The eight "–/+" pairs, shown in solid line boxes, represent the expected derivative signature indicative of pixel dropout. In these eight "–/+" pairs, the pairs are close in proximity and have similar magnitudes. FIG. 8 illustrates additional isolated "–" and "+" discontinuities 104, 106 in dashed lines that do not present the expected pixel dropout signature.

The mathematical calculations described herein for determining pixel dropout signature are for illustrative purposes only. It will be apparent to those of ordinary skill in the art that there are alternative mathematical calculations that could be employed to identify the pixel dropout signature.

Another option for determining whether pixel dropout has occurred is to compare the generated dataset of integrated intensity values from the captured image to an expected dataset of integrated intensity values generated from the print "input data" used to generate the printed image. A plot, much like that shown in FIG. 4, can be generated using the original print input data by integrating the input data along the path of printing in a manner similar to the way the captured image data is integrated. The resolution may be different, so the integrated datasets between the captured image and the input data image may need to be normalized. While comparing the two datasets, one can isolate areas whereby the two datasets are substantially different indicating areas where pixel dropout or other print abnormalities may exist.

In an embodiment, rather than generating an alert signal when a delta function-like discontinuity is discovered, the alert signal can be generated based on a user definable number of substrates having a delta function-like discontinuity. For example an alert signal can be generated if pixel dropout has occurred on a predetermined number or ratio of the substrates or print ribbon portions (for example 3 out of 5 consecutive substrates), or if pixel dropout has occurred on a predetermined consecutive number of the substrates or print ribbon portions (for example 5 consecutive substrates).

Another option is to generate an alert signal if an amount of pixel dropout exceeds a predetermined threshold on a predetermined number of the substrates or print ribbon portions. For example, an alert can be generated if there is at least a 25% change (i.e. delta function-like discontinuity) on a first predetermined number of consecutive substrates, a 50% change on a second, lower predetermined number of consecutive substrates, or a 75% change on a third, still lower predetermined number of consecutive substrates.

Figure 5:
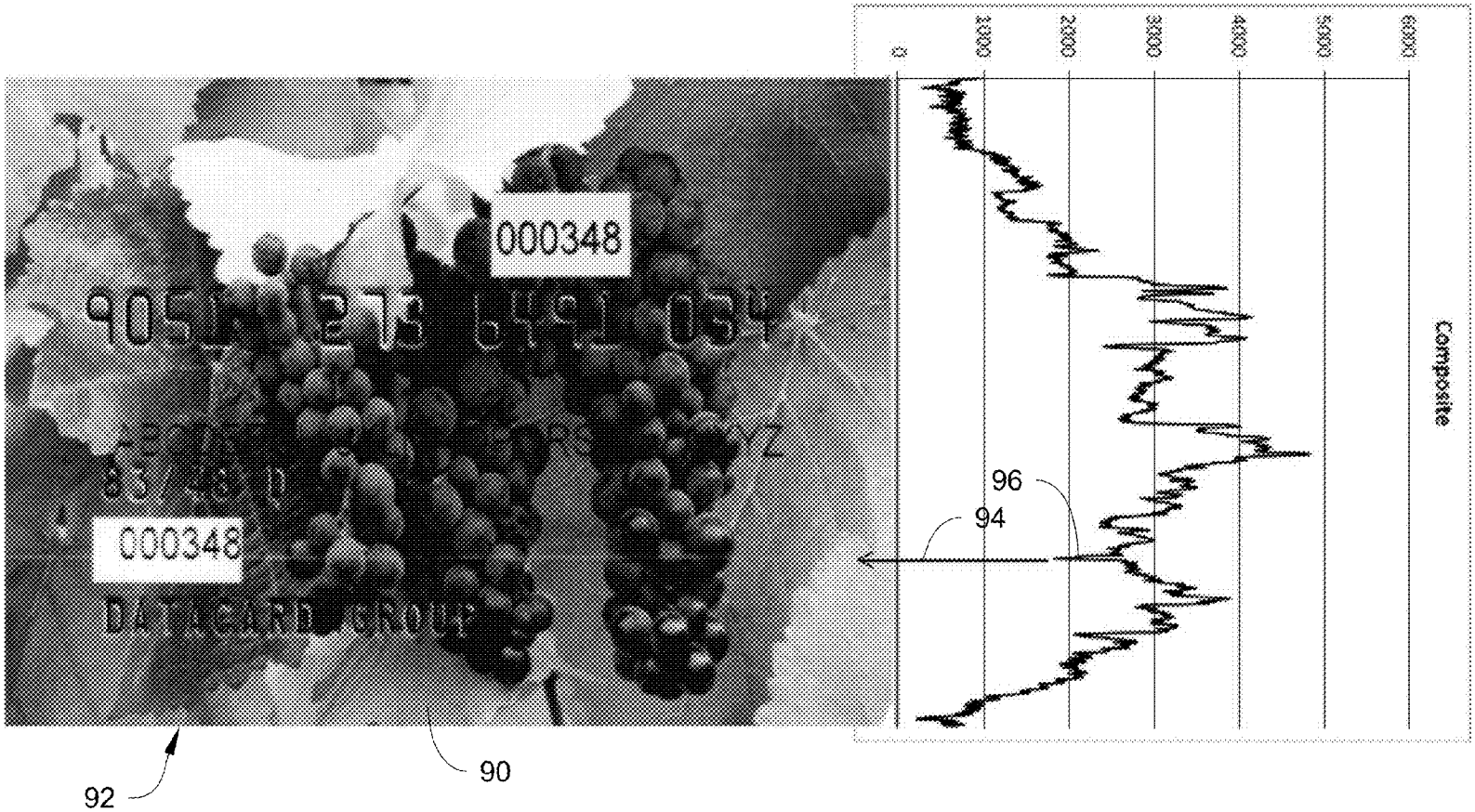
FIG. 5 is an example of a color printed substrate and a plot of integrated intensity values.

With reference now to FIG. 5, a full color image 90 is shown printed on a substrate 92. As illustrated by the arrow 94 in FIG. 5, one of the print elements on the printhead used to print the image has failed resulting in a line (i.e. pixel dropout) being formed on the image 90. The color image 90 can be formed from, for example, four-color CYMK printing, using a dye diffusion, thermal transfer print process or a retransfer printing process.

The processing device processes the captured image to generate a dataset of integrated intensity values, in the printing direction Y-Y, of the captured image along the entire width W of the image 90, with right-hand side of FIG. 5 showing a plot of the integrated intensity values over the entire width W. The plot shows a delta function-like discontinuity appearing at location 96 which corresponds in location to the line appearing in the image 90.

Figure 6A:
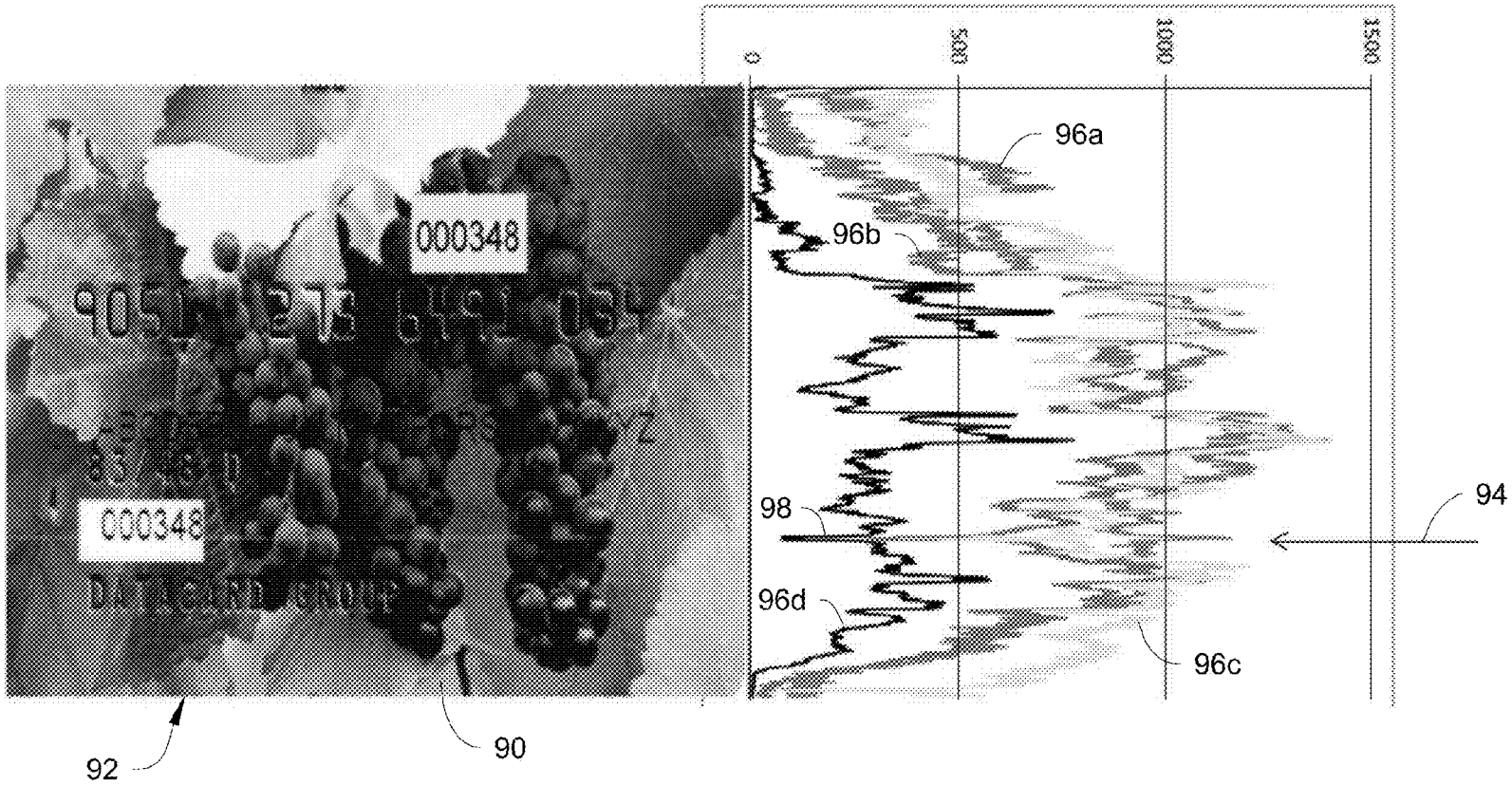
FIG. 6A is another example of a color printed substrate and a plot of integrated intensity values.

FIG. 6A shows a full color image 90 printed on the substrate 92 that is identical to the image in FIG. 5, including the line in the image (at the location of the arrow 94). In this example, it is assumed that the image 90 is printed using CMYK ribbon panels by multiple printing devices, for example using the retransfer printer in FIG. 3. In this embodiment, the processing device assumes that the image was printed using CMYK colors, even though the image could have been printed using other color combinations. The captured image is decomposed by the processing device using standard image decomposition software into individual CMYK colors, and the integrated intensity values of each color are plotted at the right-hand side of FIG. 6. For example, the plot of cyan is referenced by 96*a*, the plot of magenta is referenced by 96*b*, the plot of yellow is referenced by 96*c*, and the plot of black is referenced by 96*d*.

In the particular example of FIG. 6A, it is the magenta color that dropped out, but evidence of the dropout is also seen in the cyan, yellow, and black as indicated at location 98. The reason for this crosstalk is due to a lack of calibration between the actual shade of cyan, magenta, yellow, and black (or other color combinations) that the printer utilized to print the image and the shade of cyan, magenta, yellow, and black that the decomposition routine utilizes.

Figure 6B:
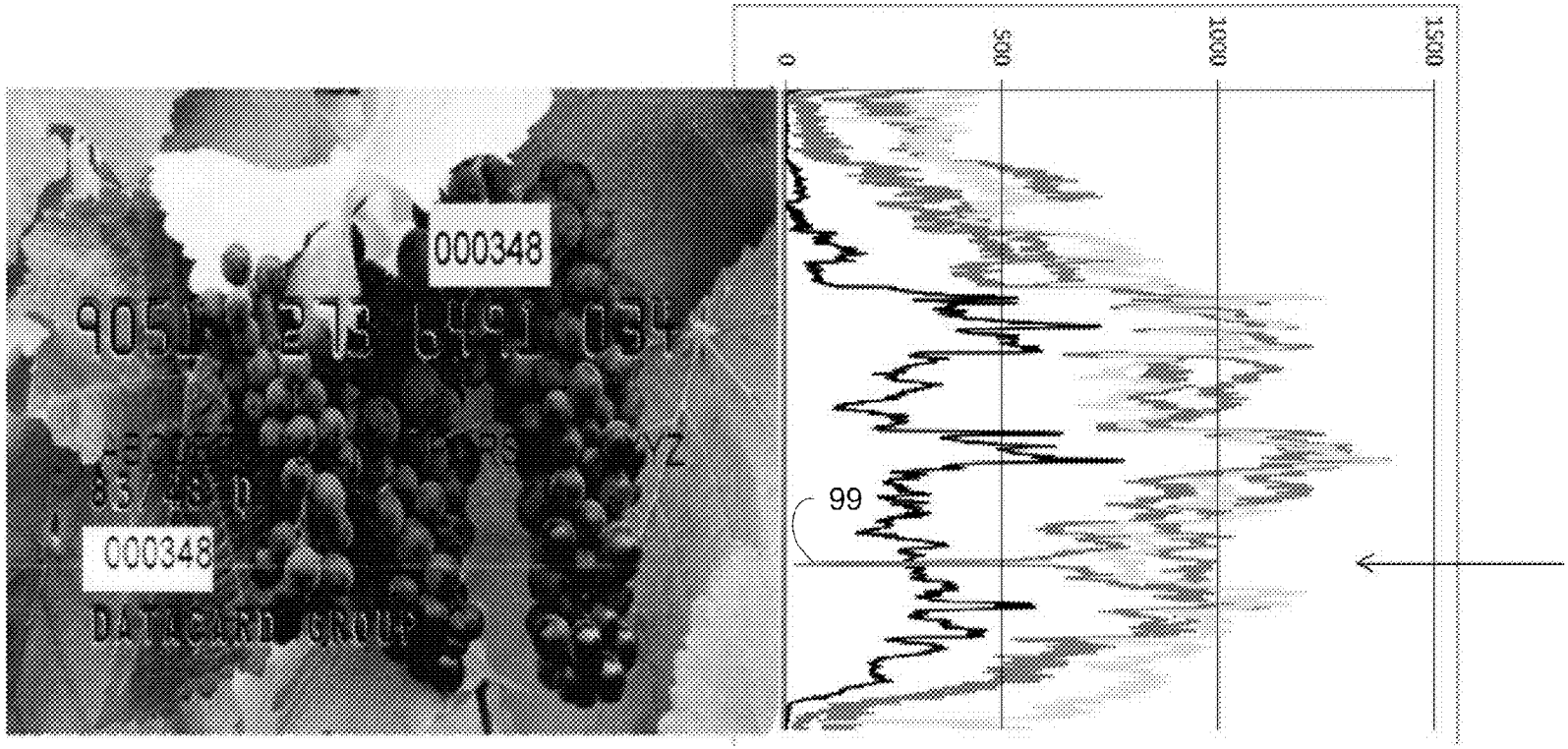
FIG. 6B is an example that is somewhat similar to FIG. 6A but where the colors are decomposed into the actual colors used to print the image.

Therefore, with reference to FIG. 6B, by calibrating the decomposition algorithm so that the algorithm knows exactly which colors were used to print the image, for example cyan, magenta, yellow, and black in exactly the shade of the print ribbon(s) or inks, the cross-talk can be eliminated and a plot obtained as shown in FIG. 6B which clearly indicates the drop out of the magenta color. The plot of each color can then be analyzed by the processing device for delta-function like discontinuities. In FIG. 6B, there is a delta-function like discontinuity at location 99 for magenta.

By performing this decomposition analysis, not only can the controller inform the operator of pixel dropout, but it can also point the operator in the direction of which printhead may have a failed element (in this case magenta).

In addition to, or separately from the decomposition software, one or more colored filters can be used to obtain the decomposed color images for generating the color plots 96*a-d*.

In an embodiment, instead of analyzing the full color image as in FIG. 5 or decomposing the color image in FIGS. 6A and 6B, an image can be captured and analyzed for pixel dropout after each color is printed. To accomplish this, an image capture device 60' can be arranged between each printhead 52*a-d* in FIG. 3. The capture devices 60' can capture an image of the substrate 56 after each printhead prints. By scanning the substrate after each printhead prints, one can determine which if any of the printheads have had a pixel dropout. However, except for the first printhead, this would require implementation of a decomposition technique as discussed above or other technique to decompose the image into individual colors. Alternatively, each of the capture devices 60' can capture an image of the print ribbon associated with the respective printhead in order to determine whether pixel dropout has occurred. By capturing images of the print ribbons, one can determine directly which if any of the printheads had a pixel dropout event without the need for performing decomposition processing.

In another embodiment, the pixel dropout detection techniques described herein are combined with one or more quality assurance or verification processes used to verify other processing on the substrate. For example, in the case of personalized security documents, verification processes include, but are not limited to, verification of printed data and images (both the content and quality), verification of embossing, verification of topping of embossed characters, verification of data on a chip, and verification of data on a magnetic stripe.

In a preferred embodiment, the printing, image capture, and processing to determine if pixel dropout has occurred are performed in the same system at generally the same time. This reduces the number of bad substrates that may be produced, and that may need to be reproduced, if any of these steps are performed at significantly different times. However, it is possible for one or more of the steps to be performed by different entities at different times, or by the same entity at different times. For example, the printing and image capture can occur at different times by the same or different parties, or the data processing to look for the delta function-like discontinuity can be performed at a time much later than the printing and/or image capture or performed by a party different than the party conducting the printing and image capture.

The description above specifically discusses monochromatic black and color utilizing the discrete colors of cyan, magenta, yellow, and black. Those skilled in the art will recognize that the techniques described herein can be utilized on any monochrome color (e.g. red, gold, silver, black, etc.) or with any discrete color components that make up the color spectrum (e.g. red, green, blue or cyan, light cyan, magenta, light magenta, yellow, and black).

The embodiments and individual features and steps described and illustrated in FIGS. 1-6 can be used together, individually, or in any combination thereof.

Aspects:

It is noted that any of aspects 1-18 below can be combined with each other in any combination and combined with any of aspects 19-35 in any combination, and any of aspects 19-35 can be combined with each other in any combination.

Aspect 1. A method of determining pixel dropout of a printhead that has a plurality of print elements arrayed along a first axis, comprising:

a) using a mechanical image capture device to capture an image printed on a surface of a substrate using the printhead or to capture an image of a portion of a print ribbon that was used to print on the substrate using the printhead;

b) inputting the captured image into a processing device and using the processing device to generate a dataset of integrated intensity values, in a printing direction, of the captured image; and c) using the dataset to determine if pixel dropout has occurred.

Aspect 2. The method of aspect 1, wherein c) comprises:

using the processing device to analyze the dataset for a delta function-like discontinuity in the integrated intensity values; and the processing device generating an alert signal if a delta function-like discontinuity is discovered.

Aspect 3. The method of aspect 1, wherein c) comprises:

using the processing device to compare the dataset generated from the captured image to an expected dataset generated from print data used to generate the printing.

Aspect 4. The method of aspect 1, further comprising printing on the surface of the substrate using the printhead by moving the substrate and the printhead relative to one another in the printing direction that is generally perpendicular to the first axis;

Aspect 5. The method of aspect 4, further comprising printing on surfaces of a plurality of substrates, and generating an alert signal if pixel dropout has occurred on a predetermined number of the substrates or print ribbon portions.

Aspect 6. The method of aspect 5, comprising generating the alert signal if pixel dropout has occurred on a predetermined consecutive number of the substrates or print ribbon portions, on a predetermined percentage of the substrates or print ribbon portions, or if an amount of pixel dropout exceeds a predetermined threshold on a predetermined number of the substrates or print ribbon portions.

Aspect 7. The method of aspect 1, wherein the printed image is monochromatic or multi-color.

Aspect 8. The method of aspect 7, wherein the captured image is multi-color or monochromatic.

Aspect 9. The method of aspect 8, further comprising decomposing the captured multi-color image into a plurality of color datasets, each dataset representing an individual color; and analyzing each of the color datasets to determine if pixel dropout has occurred for a particular color.

Aspect 10. The method of aspect 9, further comprising using color filters to capture specific color images.

Aspect 11. The method of aspect 4, wherein printing comprises printing using a plurality of the printheads, each printhead printing a CMYK color;

capturing an image of the substrate surface or print ribbon portion after one or more of the printheads print; and for each captured image, generate a dataset of integrated intensity values, in the printing direction, of the captured image.

Aspect 12. The method of aspect 1, wherein the substrate is a plastic card, a page of a passport, or a retransfer film.

Aspect 13. The method of aspect 1, wherein the printhead is a thermal printhead and the print elements are an array of a plurality of resistors.

Aspect 14. The method of aspect 1, wherein the printhead is an inkjet printhead and the print elements are an array of a plurality of jets.

Aspect 15. The method of aspect 12, further comprising performing a verification process on the plastic card, passport page, or retransfer film.

Aspect 16. The method of aspect 15, wherein the verification process comprises one or more of the following:

verification of printed data;

verification of a printed image;

verification of embossing;

verification of topping;

verification of data on a chip; and verification of data on a magnetic stripe.

Aspect 17. The method of aspect 1, wherein the image capture device comprises a camera or a scanner.

Aspect 18. The method of aspect 17, wherein the image capture device has a resolution greater than or approximately equal to a resolution of the printhead.

Aspect 19. A system, comprising:

a mechanical image capture device associated with a printhead to capture an image printed on a surface of a substrate using the printhead or to capture an image of a portion of a print ribbon that was used to print on the substrate using the printhead; and a processing device connected to the mechanical image capture device and receiving the captured image from the mechanical image capture device, the processing device is configured to generate a dataset of integrated intensity values, in a printing direction, of the captured image, and the processing device is configured to analyze the generated dataset to determine if pixel dropout has occurred and to generate an alert signal if pixel dropout has occurred.

Aspect 20. The system of aspect 19, further comprising a printhead having a plurality of print elements arrayed along a first axis.

Aspect 21. The system of aspect 20, wherein the printhead is a thermal printhead and the print elements are an array of a plurality of resistors.

Aspect 22. The system of aspect 20, wherein the printhead is an inkjet printhead and the print elements are an array of a plurality of jets.

Aspect 23. The system of aspect 19, wherein the mechanical image capture device comprises a camera or a scanner.

Aspect 24. The system of aspect 23, wherein the mechanical image capture device has a resolution greater than or approximately equal to a resolution of the printhead with which it is associated.

Aspect 25. The system of aspect 19, wherein the substrate is a plastic card, a page of a passport, or a retransfer film.

Aspect 26. The system of aspect 19, wherein the system is part of a desktop processing machine, or the system is part of a processing machine having a plurality of processing stations or modules that processes a plurality of substrates at the same time.

Aspect 27. The system of aspect 19, wherein the processing device is configured to analyze the dataset for a delta function-like discontinuity in the integrated intensity values, and is configured to generate the alert signal if a delta function-like discontinuity is discovered.

Aspect 28. The system of aspect 19, wherein the processing device is configured to compare the dataset generated from the captured image to an expected dataset generated from print data used to generate the printing.

Aspect 29. The system of aspect 19, wherein the processing device is configured to generate the alert signal if pixel dropout has occurred on a predetermined number of the substrates or print ribbon portions.

Aspect 30. The system of aspect 29, wherein the processing device is configured to generate the alert signal if pixel dropout has occurred on a predetermined consecutive number of the substrates or print ribbon portions, on a predetermined percentage of the substrates or print ribbon portions, or if an amount of pixel dropout exceeds a predetermined threshold on a predetermined number of the substrates or print ribbon portions.

Aspect 31. The system of aspect 20, wherein the printhead is configured to print a monochromatic image or a multi-color image.

Aspect 32. The system of aspect 31, wherein the mechanical image capture device is configured to capture a multi-color image or a monochromatic image.

Aspect 33. The system of aspect 32, wherein the processing device is configured to decompose the captured multi-color image into a plurality of color datasets, each dataset representing an individual color, and to analyze each of the color datasets to determine if pixel dropout has occurred for a particular color.

Aspect 34. The system of aspect 33, further comprising color filters to capture specific color images.

Aspect 35. The system of aspect 20, further comprising a plurality of the printheads, each printhead printing a CMYK color; and one of the mechanical image capture devices associated with each of the printheads.

The embodiments disclosed in this application are to be considered in all respects as illustrative and not limitative. The scope of the claimed invention is indicated by any appended claims rather than by the foregoing description, and all changes which come within the meaning and range of equivalency of the claims are intended to be embraced therein.

The invention claimed is:

1. A method of determining pixel dropout of a printhead that has a plurality of print elements arrayed along a first axis, comprising:

a) using a mechanical image capture device to capture an image of printing on a retransfer film, the printing is printed on the retransfer film using the printhead;

b) inputting the captured image of the printing into a processing device and using the processing device to generate a dataset of integrated intensity values, in a printing direction, of the captured image of the printing; and c) using the dataset to determine if pixel dropout has occurred, including using the processing device to compare the dataset generated from the captured image of the printing to an expected dataset generated from print data used to generate the printing on the retransfer film.

2. The method of claim 1, comprising printing on a plurality of discrete sections of the retransfer film.

3. The method of claim 1, further comprising printing on the retransfer film by moving the retransfer film and the printhead relative to one another in the printing direction that is generally perpendicular to the first axis.

4. The method of claim 2, further comprising generating an alert signal if pixel dropout has occurred on a predetermined number of the discrete sections of the retransfer film.

5. The method of claim 4, comprising generating the alert signal if pixel dropout has occurred on a predetermined consecutive number of the discrete sections of the retransfer film, on a predetermined percentage of the discrete sections of the retransfer film, or if an amount of pixel dropout exceeds a predetermined threshold on a predetermined number of the discrete sections of the retransfer film.

6. The method of claim 1, wherein the printhead is a thermal printhead and the print elements are an array of a plurality of resistors.

7. The method of claim 1, wherein the printhead is an inkjet printhead and the print elements are an array of a plurality of jets.

8. The method of claim 1, wherein the image capture device comprises a camera or a scanner.

9. The method of claim 8, wherein the image capture device has a resolution greater than or approximately equal to a resolution of the printhead.

10. A system, comprising:

a printhead having a plurality of print elements arrayed along a first axis;

a mechanical image capture device associated with the printhead to capture an image of printing on a retransfer film, where the printing is printed on the retransfer film using the printhead; and a processing device connected to the mechanical image capture device and receiving the captured image of the printing from the mechanical image capture device, the processing device generates a dataset of integrated intensity values, in a printing direction, of the captured image of the printing, and the processing device analyzes the generated dataset by comparing the dataset generated from the captured image of the printing to an expected dataset generated from print data used to generate the printing on the retransfer film to determine if pixel dropout has occurred and generates an alert signal if pixel dropout has occurred.

11. The system of claim 10, wherein the system is part of a desktop processing machine, or the system is part of a processing machine having a plurality of processing stations or modules.

12. A method of determining pixel dropout of a printhead that has a plurality of print elements arrayed along a first axis, comprising:

a) using a mechanical image capture device to capture an image of printing on a surface of a card, the printing is printed on the surface of the card using the printhead;

b) inputting the captured image of the printing into a processing device and using the processing device to generate a dataset of integrated intensity values, in a printing direction, of the captured image of the printing; and c) using the dataset to determine if pixel dropout has occurred, including using the processing device to compare the dataset generated from the captured image of the printing to an expected dataset generated from print data used to generate the printing on the surface of the card.

13. The method of claim 12, further comprising printing on the surface of the card by moving the card and the printhead relative to one another in the printing direction that is generally perpendicular to the first axis.

14. The method of claim 12, further comprising printing on a plurality of cards, and further comprising generating an alert signal if pixel dropout has occurred on a predetermined number of the cards.

15. The method of claim 14, comprising generating the alert signal if pixel dropout has occurred on a predetermined consecutive number of the cards, on a predetermined percentage of the cards, or if an amount of pixel dropout exceeds a predetermined threshold on a predetermined number of the cards.

16. The method of claim 12, wherein the printhead is a thermal printhead and the print elements are an array of a plurality of resistors.

17. The method of claim 12, wherein the printhead is an inkjet printhead and the print elements are an array of a plurality of jets.

18. The method of claim 12, wherein the image capture device comprises a camera or a scanner.

19. The method of claim 18, wherein the image capture device has a resolution greater than or approximately equal to a resolution of the printhead.

* * * * *